US008312962B2

(12) United States Patent
Melcher et al.

(10) Patent No.: US 8,312,962 B2
(45) Date of Patent: Nov. 20, 2012

(54) SOUND ABSORBER HAVING HELICAL FIXTURES

(75) Inventors: Jörg Melcher, Lehre (DE); Daniel Fingerhut, Denkte (DE); Christian Melcher, Lehre (DE)

(73) Assignee: Deutsches Zentrum fur Luft-und Raumfahrt E.V., Cologne (DE)

( * ) Notice: Subject to any disclaimer, the term of this patent is extended or adjusted under 35 U.S.C. 154(b) by 0 days.

(21) Appl. No.: 13/198,779

(22) Filed: Aug. 5, 2011

(65) Prior Publication Data

US 2011/0308884 A1 Dec. 22, 2011

Related U.S. Application Data

(63) Continuation of application No. PCT/EP2010/051217, filed on Feb. 2, 2010.

(30) Foreign Application Priority Data

Feb. 5, 2009 (DE) ..... 10 2009 000 645

(51) Int. Cl.
*F01N 1/12* (2006.01)

(52) U.S. Cl. ..... 181/280; 181/279; 181/264; 181/212; 181/228; 181/227

(58) Field of Classification Search ..... 181/280, 181/279, 264, 212, 228, 227, 241, 237
See application file for complete search history.

(56) References Cited

U.S. PATENT DOCUMENTS

| | | | | | |
|---|---|---|---|---|---|
| 2,031,451 | A | * | 2/1936 | Austin | 181/241 |
| 2,359,365 | A | * | 10/1944 | Katcher | 181/280 |
| 3,182,748 | A | * | 5/1965 | Wirt | 181/280 |
| 3,746,126 | A | * | 7/1973 | de Cardenas | 181/227 |
| 3,888,331 | A | * | 6/1975 | Wang | 181/253 |
| 4,079,808 | A | * | 3/1978 | Mizuno et al. | 181/237 |
| 4,339,918 | A | * | 7/1982 | Michikawa | 60/316 |
| 4,667,770 | A | * | 5/1987 | DeVane | 181/280 |
| 4,683,978 | A | * | 8/1987 | Venter | 181/280 |
| 4,792,014 | A | * | 12/1988 | Shin-Seng | 181/280 |

FOREIGN PATENT DOCUMENTS

| | | | |
|---|---|---|---|
| DE | 196 44 089 | A1 | 5/1998 |
| DE | 199 32 714 | A1 | 1/2001 |
| DE | 195 33 623 | B4 | 4/2005 |
| DE | 10 2004 006 031 | A1 | 8/2005 |
| FR | 804 593 | | 4/1936 |
| GB | 460 148 | A | 1/1937 |
| WO | 98/19054 | A1 | 5/1998 |

OTHER PUBLICATIONS

International Preliminary Report on Patentability and English Translation of Written Opinion in co-pending, related PCT Application No. PCT/EP/2010/051217, mailed Aug. 22, 2011.

* cited by examiner

*Primary Examiner* — Forrest M Phillips

(74) *Attorney, Agent, or Firm* — Thomas Horstemeyer, LLP

(57) ABSTRACT

A sound absorber comprises an elongated gas channel, through which a flowing gas passes in operation of the sound absorber; and at least one helical fixture mounted in a longitudinal section of the gas channel. The helical fixture defines a helical gas passage through the longitudinal section of the gas channel. Further, the helical fixture defines at least one longitudinal Helmholtz resonator within the gas channel which is excited by sound waves propagating in the flowing gas passing through the at least one gas channel.

20 Claims, 6 Drawing Sheets

SOUND ABSORBER HAVING HELICAL FIXTURES

CROSS-REFERENCES

The present application is a continuation to International Patent Application PCT/EP2010/051217 titled "Schalldämpfer mit helikalen Einbauten", filed on Feb. 2, 2010, and claiming priority to German Patent Application DE 10 2009 000 645.1 titled "Schalldämpfer mit mindestens einem mittels helikaler Einbauten aufgebauten Helmholtz-Resonator", filed on Feb. 5, 2009.

FIELD

The invention relates to a sound absorber comprising at least one gas channel through which a flowing gas passes. Particularly, the present invention relates to a sound absorber comprising at least one elongated gas channel, through which a flowing gas passes in operation of the sound absorber, and at least one helical fixture mounted in at least one longitudinal section of the at least one gas channel, the at least one helical fixture defining a helical gas passage through the at least one longitudinal section of the gas channel.

The flowing gas shall pass through the sound absorber as unhindered as possible. On the other hand, sound waves propagating in the flowing gas, which are to be understood as including any quick pressure fluctuations of the flowing gas here, shall be dampened as far as possible.

BACKGROUND

Besides sound absorbers in which energy is withdrawn from sound waves by gas friction in porous material, and transformed into heat, sound absorbers are known which dynamically absorb sound. In engineering, they are designated as acoustic absorbers; in physics, they are designated as dynamic absorbers. These are resonant systems which very well absorb sound occurring at their eigenfrequency and afterwards dissipate its energy. Examples for these resonant systems are so-called hole or Helmholtz resonators.

It also belongs to the known measures in the field of dynamic sound absorbers to build up acoustic resonators with the aid of one or more cross-sectional steps, i.e. by variations of the cross-section of a tube delimiting a gas channel. By means of these measures, however, the flow resistance for the gas flowing through the sound absorber is dramatically increased.

From DE 196 44 089 A1 a sound absorber for combustion engines is known which comprises a helical fixture provided in a gas channel through which a flowing gas passes, the helical fixture defines a helical gas passage through the gas channel. The sound shall be reduced by reflections and scattering at the helical surfaces of the helical fixture as well as by following absorption in the channel wall of the gas channel. Further, propagation of the sound shall be hindered by the so-called cut-off effect. For absorption of the sound in the channel wall the gas channel is enclosed by a ring channel which communicates with the gas channel via perforations, and in which a sound absorbing material, like for example ceramic wool, is arranged. Tuning to one or more main sound frequencies, i.e. a particularly high efficiency at these main sound frequencies, is not possible with the known sound absorber.

From DE 199 32 714 A1 it is known to arrange a helical membrane which is provided with anti-sound producing elements in a tube-shaped device through which air flows to actively dampen sound in the tube-shaped device. Active sound dampening with anti-sound producing elements, however, requires an active control of these elements and is correspondingly complex.

A device for reducing pressure pulsations in pipelines guiding liquids is known from DE 10 2004 006 031 A1. Here, a choke body is arranged in a pipeline of the pipeline system, which has a helix whose helix axis is oriented in a propagation direction of the pressure pulsations in the pipeline. The pressure pulsations interact with the helix. This may be a passive interaction under elastic deformation of the helix. Alternatively, the helix may be actively operated. One may also arrange a series of several choke bodies in the form of helixes at a fixed distance between the choke bodies in one pipeline. The teaching of DE 10 2004 006 031 A1, in contrary to the teaching of DE 199 32 714 A1, does expressively not relate to pipeline systems through which a flowing gas passes but only to pipeline systems guiding liquids.

An absorber for absorbing airborne sound in which an acoustic series circuit and an acoustic parallel circuit are coupled to each other, the acoustic series circuit being a Helmholtz resonator, is known from DE 195 33 623 B4. The Helmholtz resonator consists of a hollow body with an air volume and a reduction in cross-section as its opening. The parallel circuit also is a resonator which is realized by a parallel connection of an acoustic spring—realized by an air volume—and of an acoustic mass provided by the air oscillating in a neck. The acoustic series circuit and the acoustic parallel circuit are tuned to a same resonance frequency. No gas flows to the known absorber as such, but it is provided for making a generally gas tight wall in a sound absorbing way. The temporal entrance of gas into the hollow bodies or air volumes of the new absorber does—in contrary to a sound absorber through which gas flows—not result in a overall gas flow passing thereto.

GB 460,148 A discloses a sound absorber for combustion engines comprising several gas channels over which the flowing gas is distributed. In the interior of the gas channels helical fixtures can be provided. The helical fixtures may comprise intake and discharge areas at their end in which their diameter, in the flow direction of the gas, gets continuously closer from the inner to the wall of the gas channel, or gets farther away from it, respectively. The pitch of the helical fixtures of the known sound absorber may be variable. The gas channels may also comprise reductions or extensions of their free cross-section along their direction of main extension. The several gas channels are, for example, used for an extinguishing superposition of sound waves which propagate in the flowing gas.

There still is a need for a sound absorber which, by means of passive elements, comprises a high sound dampening as compared to the flow resistance for the flowing gas passing through the sound absorber.

SUMMARY

In one aspect, the present invention provides a sound absorber comprising at least one elongated gas channel, through which a flowing gas passes in operation of the sound absorber; and at least one helical fixture mounted in at least one longitudinal section of the at least one gas channel. The helical fixture defines a helical gas passage through the longitudinal section of the gas channel; and it defines at least one longitudinal Helmholtz resonator within the gas channel which is excited by sound waves propagating in the flowing gas passing through the gas channel.

In a further aspect, the present invention provides a system comprising: at least one of an engine and of a pump; and a tube including a sound absorber. The sound absorber comprises at least one elongated gas channel, through which a gas passes in operation of the sound absorber; and at least one helical fixture mounted in at least one longitudinal section of the at least one gas channel. The helical fixture defines a helical gas passage through the longitudinal section of the gas channel; and it defines at least one longitudinal Helmholtz resonator within the gas channel which is excited by sound waves propagating in the flowing gas passing through the gas channel.

Other features and advantages of the present invention will become apparent to one with skill in the art upon examination of the following drawings and the detailed description. It is intended that all such additional features and advantages be included herein within the scope of the present invention, as defined by the claims.

SHORT DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views. In all figures, one sound absorber is displayed in a perspective side view with a cut-open wall of its gas channel.

FIG. 1 shows a first sound absorber according to the invention. The sound absorber has a gas channel. In the gas channel, helical fixtures form two Helmholtz resonators tuned to a same frequency through which a gas flowing through the sound absorber passes. Further, the sound absorber has ends which are low reflective for sound waves.

FIG. 2 shows a second sound absorber according to the present invention. In the gas channel of this sound absorber, only one Helmholtz resonator is formed through which a gas flowing through the sound absorber passes. Again, the ends of the sound absorber are designed in a low reflective way for sound waves.

Figure 11:
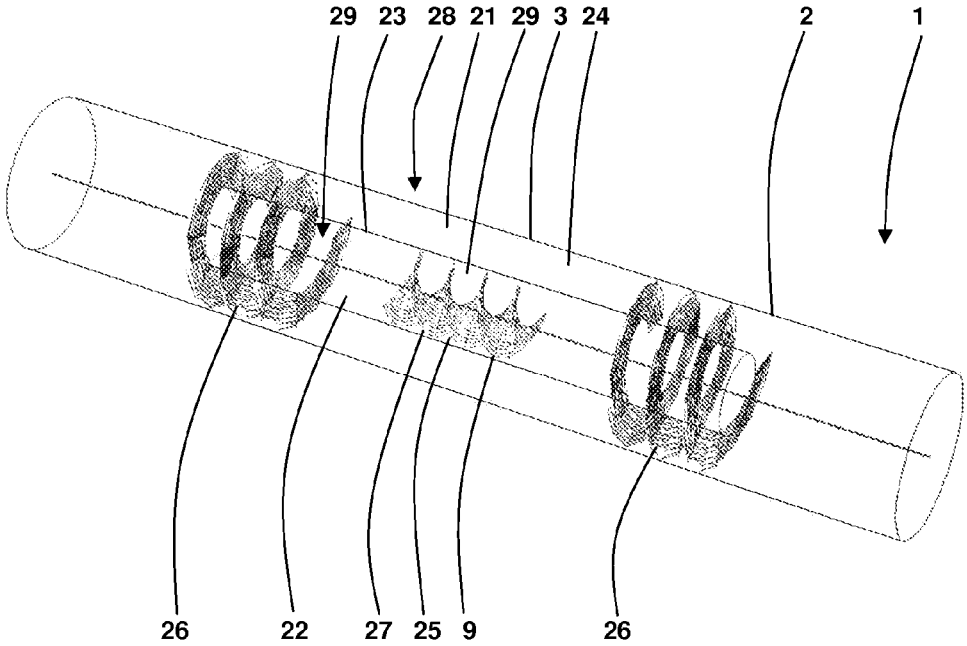

FIG. 11 shows an embodiment of the sound absorber according to the present invention in which the flowing gas is distributed over two gas channels. In each of the gas channels one Helmholtz resonator is formed. Although both Helmholtz resonators are tuned to a same resonance frequency, one of them is a formed as an acoustic parallel circuit, and the other of them is formed as an acoustic series circuit.

Figure 12:
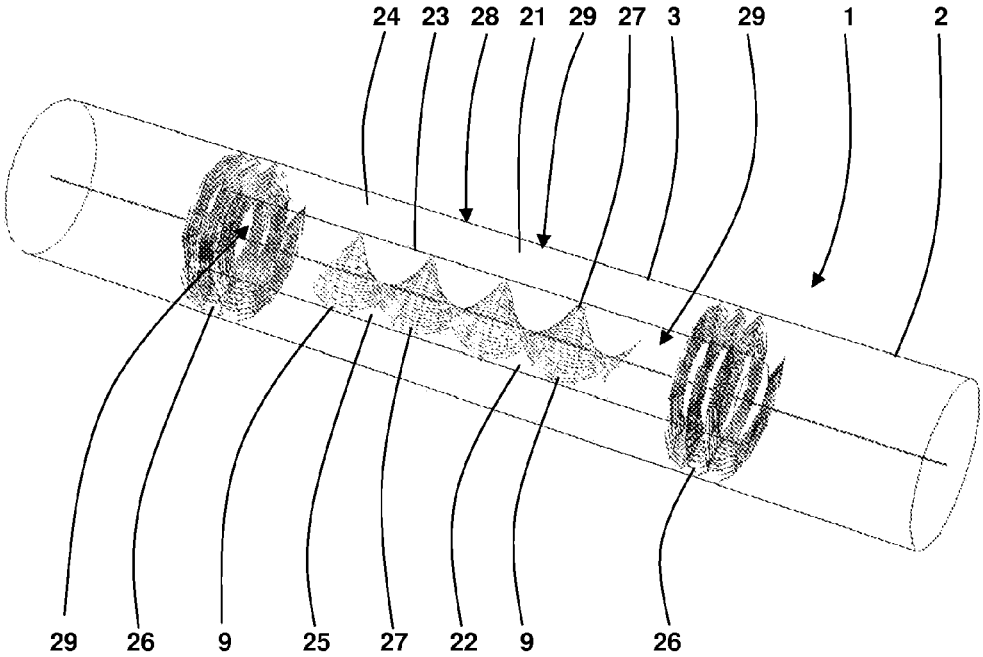

FIG. 12 shows an embodiment of the sound absorber according to the present invention in which—as a variation over FIG. 11—several Helmholtz resonators which are, however, all tuned to the same resonance frequency are arranged one behind the other in the one gas channel.

DETAILED DESCRIPTION

In a sound absorber according to the present invention, a Helmholtz resonator is formed in a gas channel by means of at least one helical fixture in the gas channel through which a flowing gas passes. The fixture gives a helical course to an inner area of the gas channel; and the Helmholtz resonator is excited by sound waves which propagate in the flowing gas passing through the gas channel. By means of one or more helical fixtures in the gas channel it is possible to form a Helmholtz resonator therein, through which gas flows with a comparatively low flow resistance. Nevertheless, the Helmholtz resonator is able to extract energy out of sound waves propagating in the flowing gas to a far extent. As a result, these sound waves are strongly dampened without strongly reducing the gas flow. This is based on the fact that it is possible to provide for impedance steps for the sound waves by means of the one or more helical fixtures without affecting the gas flow to a same extent as to an impedance step which is (only) achieved by a change in diameter of the gas channel.

Particularly, for forming a Helmholtz resonator in the new sound absorber, a cavity is delimited in the flow direction of the gas by opposite impedance steps for the sound waves propagating in the gas. In each such cavity, energy from a passing sound wave is captured whose wavelength fits to the length of the cavity, i.e. to which the Helmholtz resonator is tuned.

Within the cavity of the Helmholtz resonator the gas channel may be free, i.e. comprise no helical fixture. Within the cavity, the sound absorber may, however, also comprise another helical fixture than at the borders of the cavity or other characteristic values of the helical fixture than at the borders of the cavity. Thus, the opposite impedance steps for delimiting the cavity of the Helmholtz resonator may not only be provided by terminating or starting a helical fixture on both sides of the cavity but also by opposite changes of the pitch and/or of the diameter of the at least one helical fixture.

Particularly, the at least one helical fixture, inclusive of an enclosing wall of the gas channel, may comprise at least two local contractions or at least one local extension. A contraction has—from an acoustic point of view—the effect of an inertial mass whose impedance is very high for high frequencies. Thus, such a contraction does particularly not let pass the high frequencies. Between two such contractions a Helmholtz resonator may be formed according to the present invention. As compared to a common Helmholtz resonator, the helical fixture results in a reduced power loss of the gas flowing through the contraction in that it guides the gas through the contraction and thus particularly avoids the formation of turbulence in the gas downstream of the contraction. On the other hand, an expansion has the effect of a spring, i.e. it is very high ohmic at low frequencies. Here, the helical fixture avoids a turbulence of the gas flowing into the expansion which might otherwise create energy losses. A Helmholtz resonator may already be formed within one such expansion between its shoulders.

The gas channel of the new sound absorber may have a circular cross-sectional area which is spanned by the at least one helical fixture with a double helix. With a circular cross-sectional area of the gas channel, a single helix is—as a rule—insufficient for forming the helical fixture as it leaves a bypass area close to its axis which is little influenced by the single helix.

If, however, the gas channel has a ring-shaped cross-sectional area, it is sufficient if this area is spanned by the helical fixture with a single helix.

In the new sound absorber, several gas channels may be provided over which the flowing gas is distributed. Here, one of these gas channels may have a circular-shaped cross-sectional area and another of these gas channels may have ring-shaped cross-sectional area coaxially extending around the circular gas channel.

In all of these gas channels of the new sound absorber, Helmholtz resonators are typically formed by means of helical fixtures.

A particularly preferred embodiment of the new sound absorber is designed as a two-circuit resonant absorber in which Helmholtz resonators tuned to a same frequencies of the exciting sound waves are provided in two gas channels over which the flowing gas distributes. Here, the one or the plurality of Helmholtz resonators in the one gas channel is or are designed as acoustic parallel circuits, and the one or the plurality of Helmholtz resonators in the other gas channel is or are designed as acoustic series circuits. Thus, for the first time, a two-circuit resonance absorber as it is generally already known from DE 195 33 623 B4 finds application in a system in which a flowing gas passes through the Helmholtz resonators themselves.

Generally, several Helmholtz resonators may be provided one behind the other in one gas channel. This is, for example, preferred to dampen sound waves of a particularly disturbing main sound frequency to an as far as possible extent. In this case, all or at least some of the Helmholtz resonators arranged one behind the other are tuned to this main sound frequency. Generally, Helmholtz resonators connected one behind the other may also be tuned to different frequencies; several Helmholtz resonators may then be provided for each of these different frequencies.

Additionally, it is generally possible that at least one of the helical fixtures of the new sound absorber is actively deformable. This active deformation may, on the one hand, be used for adjusting a Helmholtz resonator formed by means of the helical fixture. Additionally, in a quasi static range, there is the option to vary the impedance steps occurring at the helical fixture. An active creation of anti-sound by active dynamic deformation of the helical fixture, however, is also possible to provide an active sound dampening effect in addition to the passive absorbing function of the Helmholtz resonators.

Whereas it is suitable for delimiting the cavity of a Helmholtz resonator in the new sound absorber to vary the impedance for the sound waves propagating in the flowing gas in an as steep step as possible, the sound waves at the ends, particularly at the entrance end of the new sound absorber, shall not be unnecessarily reflected. A low reflection soft impedance transition results, if the helical fixture at least one end of the sound absorber has an intake or discharge area in which its diameter, in the flow direction of the gas, continuously approaches the wall of the gas channel from the interior or gets away from it. The sound waves thus completely get in the new sound absorber and are purposefully absorbed therein.

Application possibilities of the new sound absorber exist in all pipes through which gas flows in which the gas displays unsteady pressure fluctuations and particularly sound waves. Such pipes exist in combustion engines, heating systems, like for example for the discharge gas of a burner, air ventilation systems and the like. Particularly, the new sound absorber is advantageously applied if the sound waves or the unsteady pressure fluctuations display a fixed frequency to which the Helmholtz resonator may be tuned.

Figure 1:
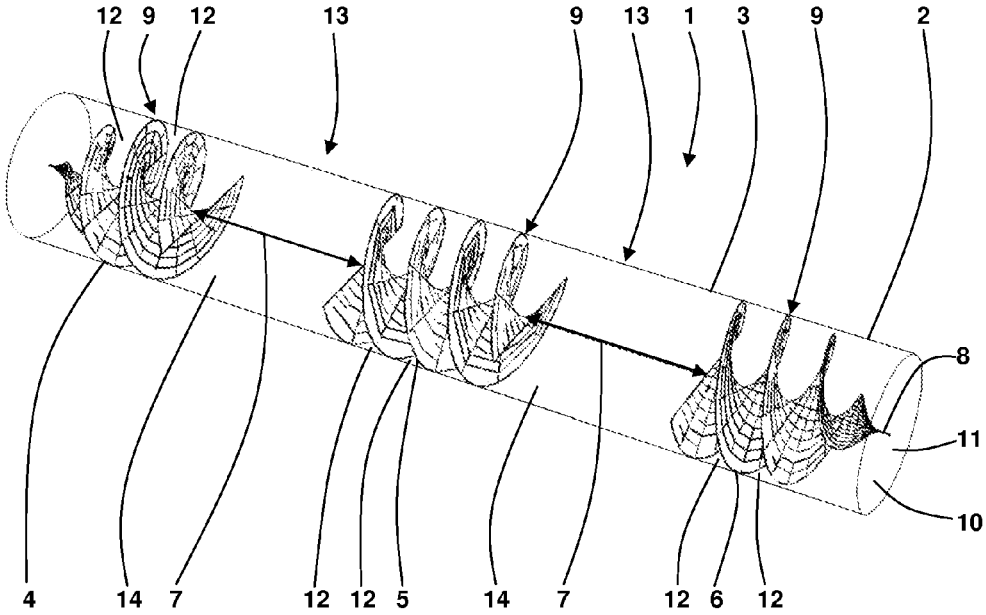

Referring now in greater detail to the drawings, the sound absorber 1 illustrated in FIG. 1 comprises three helical fixtures 4, 5 and 6 within a tube 2 having a wall 3. Here, the helical fixture 5 is located between the helical fixtures 4 and 6 at the ends of the sound absorber 1 and has a same free distance 7 in the direction of the tube axis 8 of the tube 2 with regard to each of the helical fixtures 4 and 6. Each of the helical fixtures 4 to 6 consists of a double helix 9 twisted about the tube axis 8. At the ends of the sound absorber 1, the diameter of the double helix 9 of the helical fixtures 4 and 6 continuously decreases from the diameter of the tube 2 to zero. Everywhere, where the double helix 9 comprises the diameter of the tube 2 it is fixed to the wall 3. Thus, the distances 7 are also fixed. The double helix 9 provides a helical course to an inner area 10 of a gas channel 11 which extends through the tube 2 and is delimited by the wall 3. Here, each double helix 9 separates two helical partial inner areas or helical passages 12 of the gas channel 8 with from each other. The helical fixtures 4 to 6 result in an increase in flow resistance for a flowing gas passing through the gas channel 11 along the tube axis 8. This increase in flow resistance, however, remains particularly small. For sound waves propagating in the flowing gas, however, the helical fixtures 4 to 6 mean a strong variation in impedance. At the ends of the sound absorber 1 this variation is continuous due to the continuously varying diameter of the double helices. There, where the helical fixtures 4 to 6, however, terminate abruptly, i.e. at both ends of both distances 7, steep impedance steps occur. In this way, two Helmholtz resonators 13 are formed in the sound absorber 1 whose chambers or cavities 14 correspond to the free tube cross-section along the distances 7. Due to the same distances 7, both Helmholtz resonators 13 are tuned to a same frequency which typically is a main sound frequency occurring in the gas flowing through the gas channel 11. The Helmholtz resonators 13 take energy from sound waves of this main sound frequency which is finally dissipated into heat. This occurs, as compared to the efficiency of the sound absorption, at an only minimum impairment to the gas flow, i.e. at a minimum flow resistance for the flowing gas.

Figure 2:
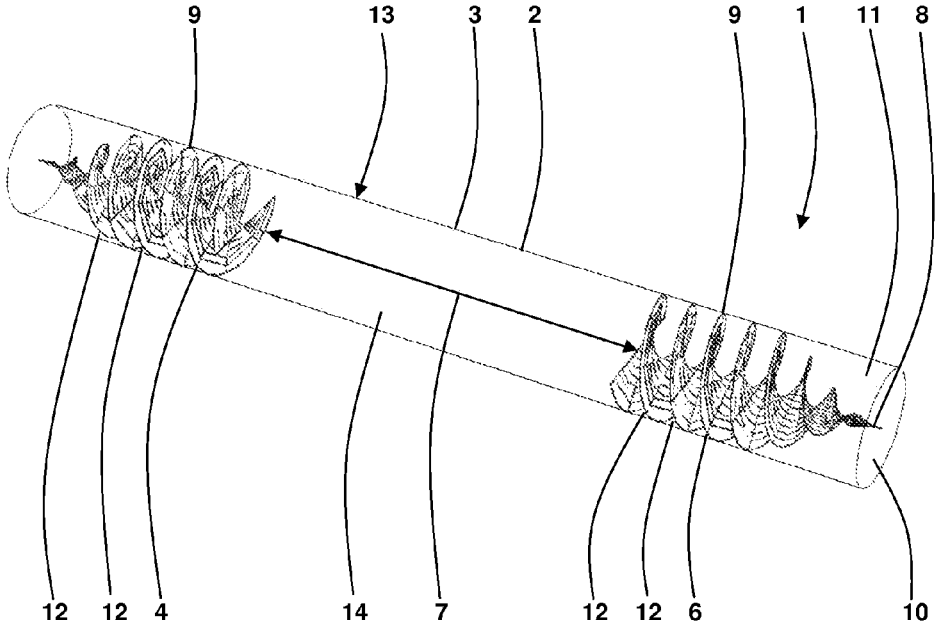

The embodiment of the sound absorber 1 according to FIG. 2 differs from that one according to FIG. 1 in that only one Helmholtz resonator 13 is formed in which no additional helical fixture is provided between the helical fixtures 4 and 6. Further, the geometric proportions in the helical fixtures 4 and 6 are different to that in FIG. 1 in that the number of winding is higher and in that the intake or discharge areas at the ends in which the diameter of the double helices continuously decrease from the diameter of the tube 2 to zero is stretched over a longer distance. The frequencies to which the sound absorber 1 is tuned essentially depends on the length of the cavities 14 of its Helmholtz resonators 13, i.e. on the distance 7. This length has to be tuned in such a way that standing waves at the wavelength of the main sound frequency of interest may be formed. I.e. not only the geometric distance 7 but also the sound propagation velocity within the gas channel 10 and thus the gas in the gas channel 10 and its condition are relevant.

Figure 3:
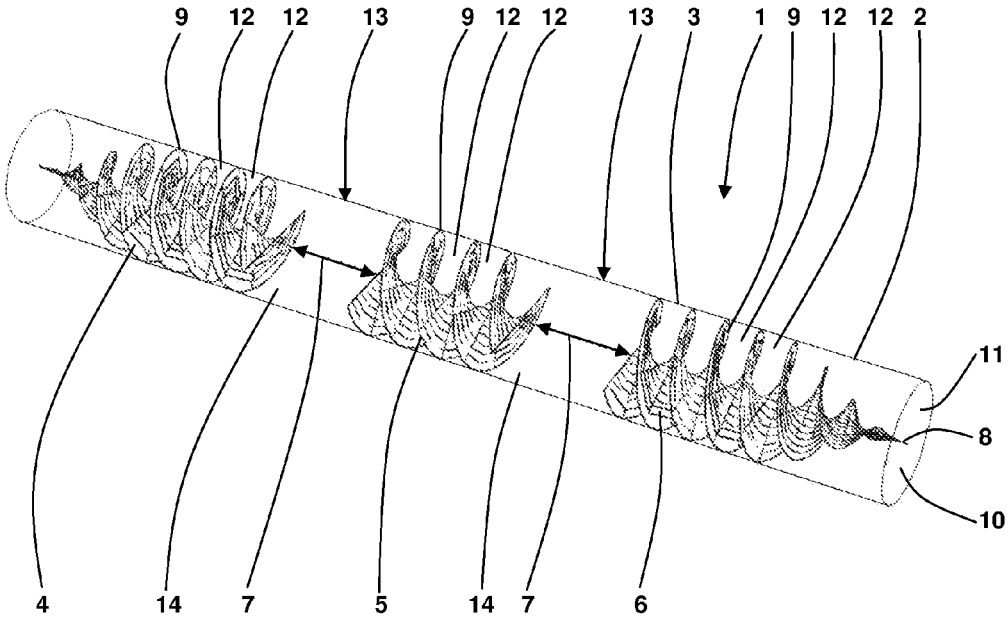
FIG. 3 shows a variation of the sound absorber of FIG. 1 according to the present invention in which the helical fixtures at its ends comprise a higher number of windings than in the embodiment of FIG. 1.

The sound absorber 1 according to FIG. 3 essentially corresponds to FIG. 1, i.e. there is an additional helical fixture 5 again. The geometric data of the sound absorber 1, however, are varied as compared to FIG. 1.

Figure 4:
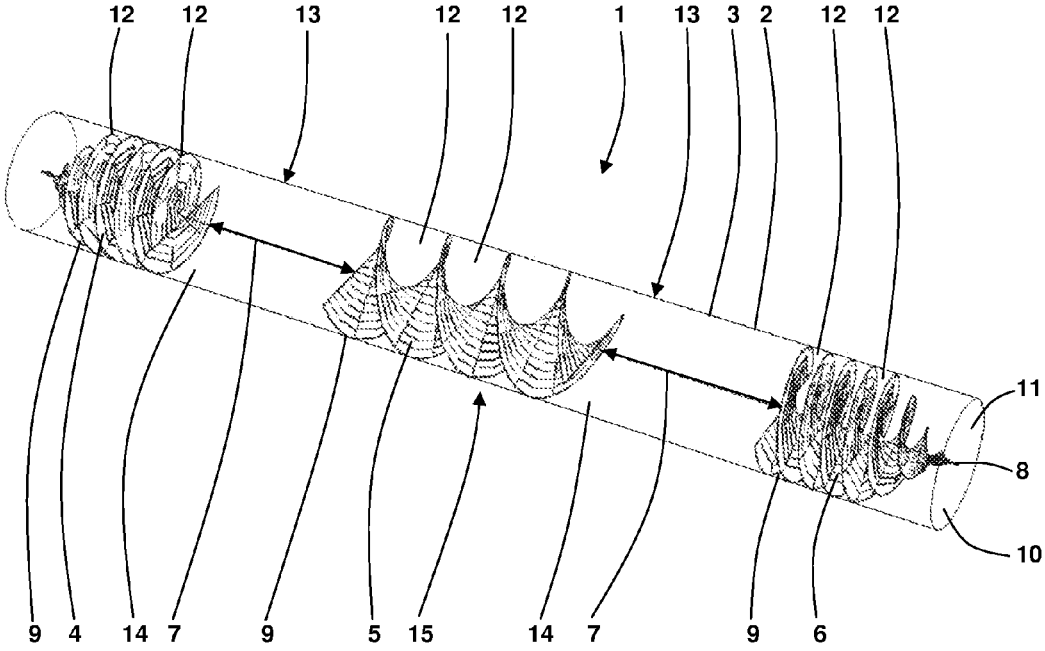
FIG. 4 shows a variation of the sound absorber of FIGS. 1 and 3 according to the present invention in which the helical fixtures at its ends and a central helical fixture in its gas channel display highly different pitches.

The sound absorber 1 according to FIG. 4 also differs from that one according to FIGS. 1 and 3 with regard to its geometric dimensions. Whereas up to now all double helices 9 in the helical inserts 4 to 6 had the same pitch, the helical fixture 5 has a strongly increased pitch here. In this way, a further Helmholtz resonator 15 may be formed whose cavity extends along the helical partial inner area 12 in the area of the helical fixture 5. Generally, the formation of such a further Helmholtz resonator 15 is possible in all helical fixtures 4 to 6. However, the dampening within the helical fixtures 4 to 6 quickly gets too high for the formation of an effective resonator with smaller pitch of the double helices 9. At the ends of the helical fixtures 4 and 6 shown up to now, the function of a Helmholtz resonator is also hindered by the phasing out diameter of the double helices 9 as it results in a floating impedance transition and no impedance step. A floating impedance transition does not reflect sound waves propagating in the gas passing through the gas channel 11 and is thus not suitable for delimiting the cavity of a Helmholtz resonator. In the sound absorber 1 this floating transition purposefully serves for letting the sound waves unhindered enter the sound absorber 1 to absorb them therein.

Figure 5:
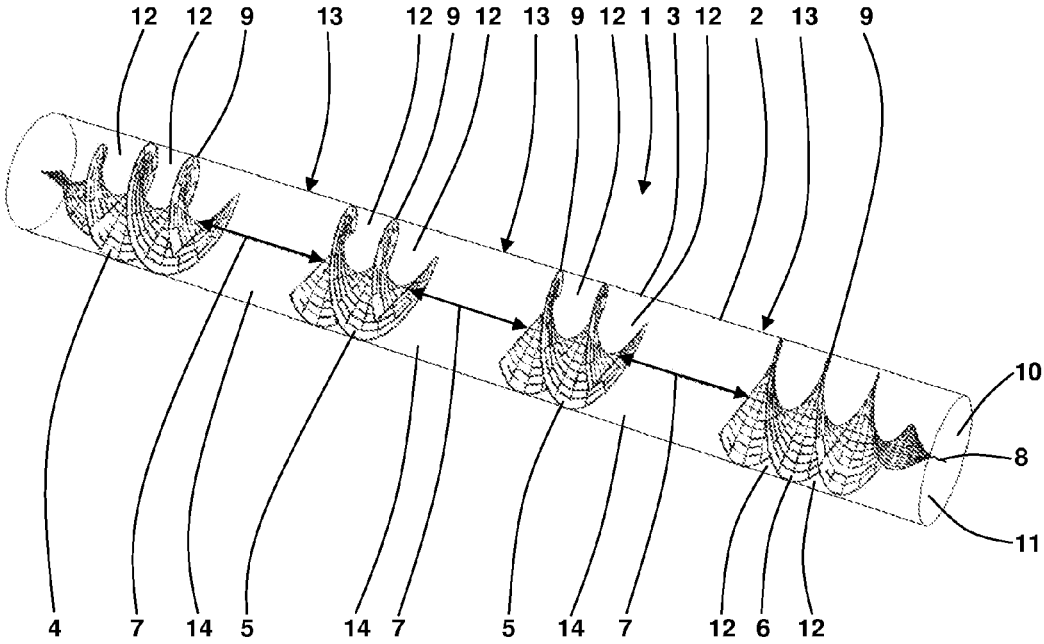
FIG. 5 shows a variation of the sound absorber of FIGS. 1 and 3 according to the present invention in which three Helmholtz resonators tuned to a same frequency are formed in the gas channel one behind the other.

The sound absorber 1 according to FIG. 5 again comprises same pitches of the double helices 9 with all helical fixtures 4 to 6. Now, however, two helical fixtures 5 are provided between the helical fixtures 4 and 6 at the ends of the sound absorber 1. Further, the distance 7 between these helical fixtures 5 is the same as towards the helical fixtures 4 and 6. Correspondingly, three Helmholtz resonators 13 are formed here. Depending on the design of the helical fixtures 5, further Helmholtz resonators 15 (not depicted here) may generally be formed in their areas.

Figure 6:
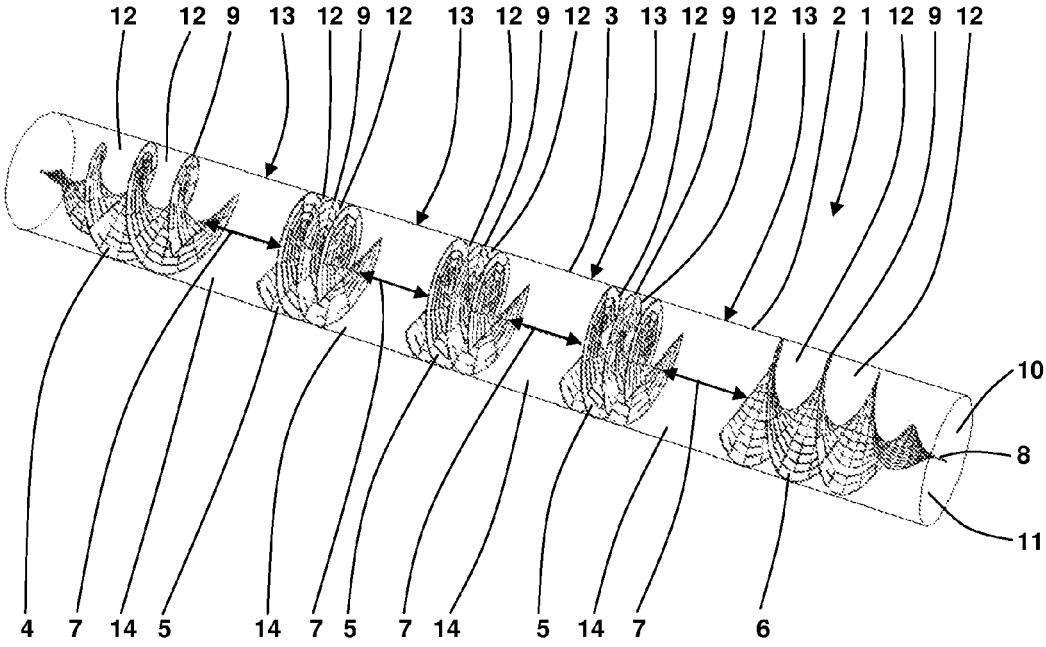
FIG. 6 shows a variation of the sound absorber of FIGS. 1 and 3 according to the present invention in which four Helmholtz resonators tuned to a same frequency are formed in the gas channel one behind the other.

The sound absorber 1 according to FIG. 6 comprises even one further intermediate helical fixture 5 so that a total of four Helmholtz resonators 13 are formed between the helical fixtures 4 to 6. Further, the pitch of the double helices 9 of the helical fixtures 5 is much smaller than with the double helices 9 of the helical fixtures 4 and 6 and the ends of the sound absorber 1.

Figure 7:
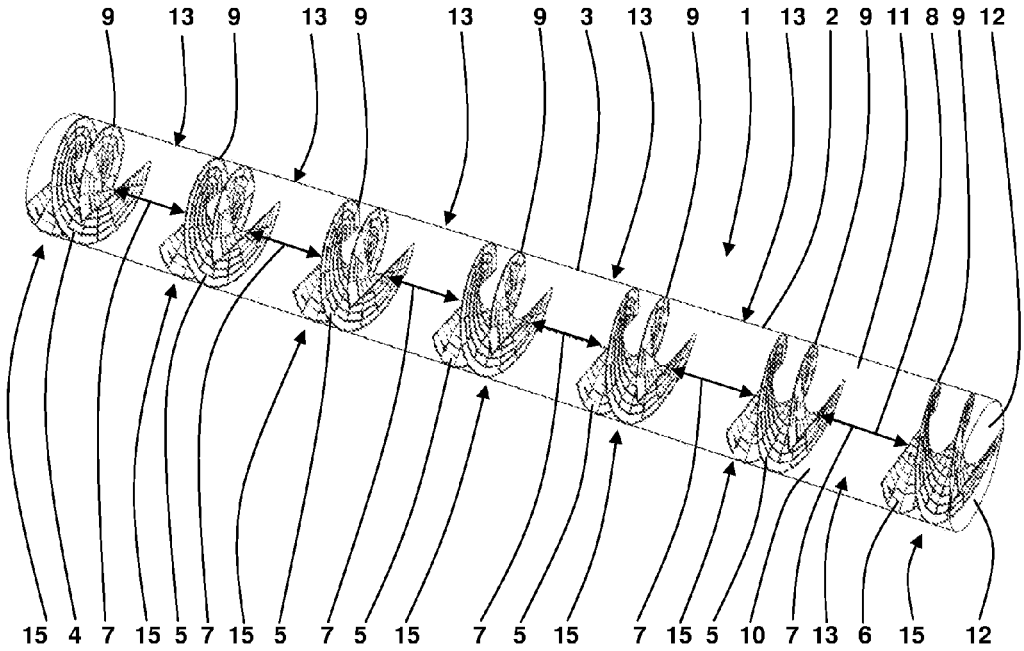
FIG. 7 shows a variation of the sound absorber according to the present invention in which a total of six Helmholtz resonators are formed within the gas channel one behind the other. Other than in the previous figures, the helical fixtures at the ends of this embodiment of the sound absorber do not comprise intake or discharge areas with low sound reflection.

FIG. 7 shows a sound absorber 1 in which, on the one hand, six Helmholtz resonators are formed over six free distances 7 by means of a total of five intermediate helical fixtures 5 arranged between the helical fixtures 4 and 6 at the ends of the sound absorber 1, and in which, on the other hand, the helical fixtures 4 and 6 at the ends terminate abruptly, i.e. with a full diameter of their double helices 9. In this way, steep impedance steps are also formed at the ends of the sound absorber 1. Correspondingly, a further Helmholtz resonator 15 may also be formed within each helical fixture 4-6.

Figure 8:
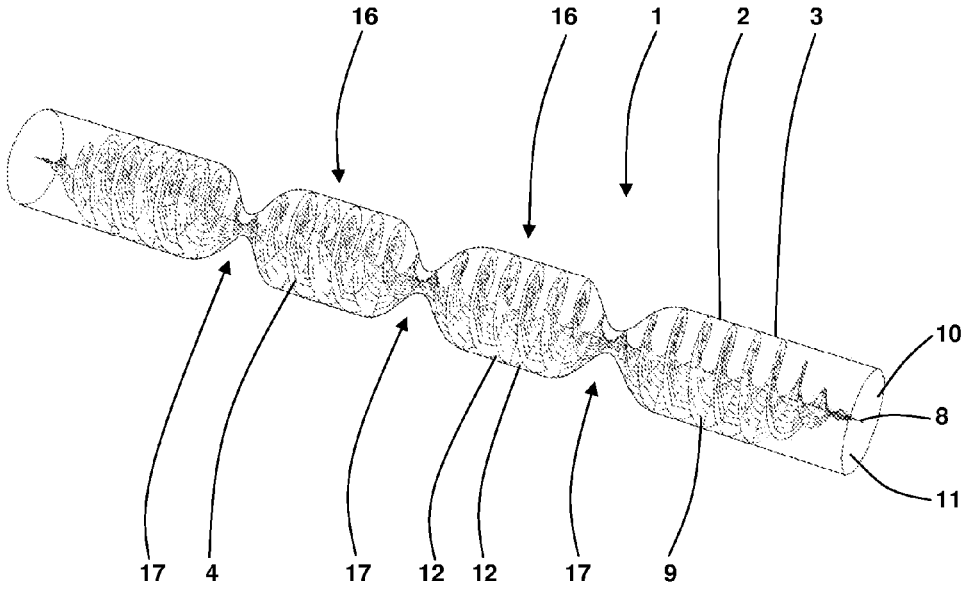
FIG. 8 shows a sound absorber according to the present invention in which two Helmholtz resonators are formed by three contractions both of a helical fixture in the gas channel and of a wall enclosing the gas channel.

FIG. 8 illustrates a sound absorber 1 in whose tube 2 only a single helical fixture 4 is provided. This helical fixture 4 phases out at both ends of the sound absorber 1 with a continuously declining diameter of its double helix 9 towards the tube axis 8 to form low reflection transition areas. For forming two Helmholtz resonators 16, the helical fixture 4 and the tube 2 comprise three common contractions 17. The contractions have the acoustic effect of an inertial mass whose impedance for high frequency becomes very high so that high frequency sound waves are reflected between the contractions 17.

Figure 9:
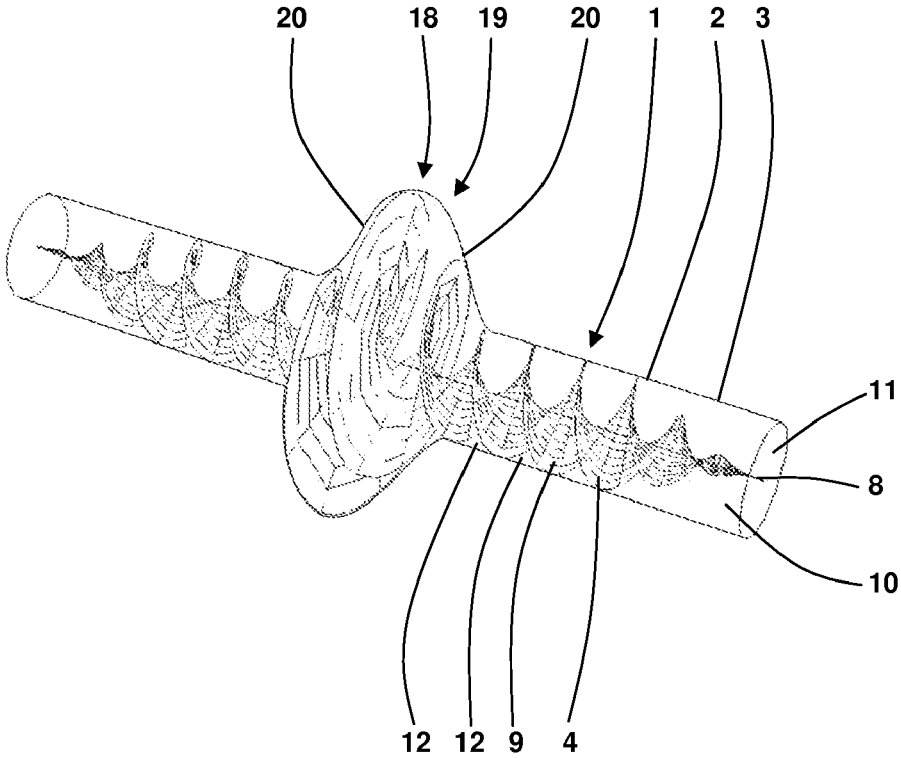
FIG. 9 shows an embodiment of the sound absorber according to the present invention in which a Helmholtz resonator is formed by an expansion of the cross-section of the gas channel including the helical fixture provided therein.

In the sound absorber 1 according to FIG. 9 the tube 2 and the helical fixture 4 only display one expansion 19 instead of the contraction 17 according to FIG. 8 for forming a Helmholtz resonator 18 between its shoulders 20. The entire expansion 19 has the effect of a spring.

Figure 10:
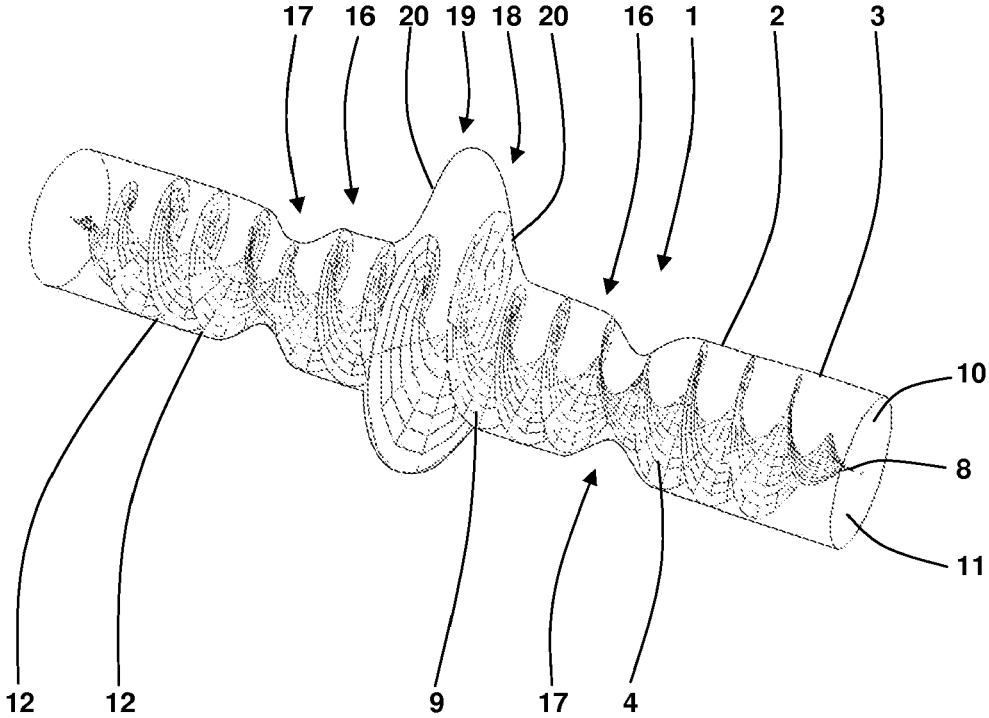
FIG. 10 shows a sound absorber according to the present invention comprising a series connection of a Helmholtz resonator according to FIG. 8, of a Helmholtz resonator according to FIG. 9 and of a further Helmholtz resonator according to FIG. 8, the contractions and the expansion not being as pronounced as in the preceding FIGS. 8 and 9.

In the embodiment of the sound absorber 1 according to FIG. 10 contractions 17 according to FIG. 8 and the expansion 19 according to FIG. 9 are combined to form various Helmholtz resonators 16 and 18.

By means of the sound absorbers 1 according to FIGS. 11 and 12 the principle of a two-circuit resonance absorber generally known from DE 195 33 623 B4 comprising an acoustic series circuit and an acoustic parallel circuit is applied to a sound absorber through which a flowing gas passes. For this purpose, the gas is distributed over two gas channels 21 and 22, the gas channel 21 being a ring channel which defined between the tube 2 and an inner tube 23, whereas the gas channel 22 extends through the inner tube 23. The inner areas 24 and 25 of the gas channels 21 and 22 are here formed by helical fixtures 26 and 27 into helical passages. Here, only the helical fixtures 27 in the inner tube 23 are compulsory double helices 9. The helical inserts 6 in the ring-shaped gas channel 21 may also be single helices as it is depicted here. With the helical fixtures 26 and 27 Helmholtz resonators 28 and 29 are formed in both gas channels 21 and 22. However, the sequence of the helical fixtures 26 and 27 and of their free distances is inverted between the gas channels 21 and 22. I.e. helical fixtures are located at the ends of the gas channel 21 and free spaces are located at the ends of the gas channel 22. The acoustic parallel circuit is formed by the gas channel 22 comprising the free spaces at the ends. These form acoustic springs, whereas the helical fixtures 26 and 27 correspond to acoustic masses. In the two circuit resonance absorbers illustrated in FIGS. 11 and 12 a particularly high absorption performance is achieved at the main sound frequency to which the individual Helmholtz resonators 28 and 29 are tuned. The two embodiments of the sound absorber according to FIGS. 11 and 12 only differ with regard to the geometric construction of the helical fixtures 26 and 27.

The invention claimed is:

1. A sound absorber comprising:

at least one elongated gas channel, through which a flowing gas passes in operation of the sound absorber; and at least one helical fixture mounted in at least one longitudinal section of the at least one gas channel, wherein the at least one helical fixture separates two helical gas passages through the at least one longitudinal section of the gas channel;

wherein the at least one helical fixture comprises at least one longitudinal end region in which an outer diameter of the at least one helical fixture tapers and gets away from a wall circumferentially enclosing the at least one gas channel resulting in a low reflection soft impedance transition;

wherein the at least one helical fixture defines at least one longitudinal Helmholtz resonator within the gas channel which is excited by sound waves propagating in the flowing gas passing through the at least one gas channel; and wherein the at least one longitudinal Helmholtz resonator comprises a longitudinal cavity within the at least one gas channel, which is delimited by opposite impedance steps for the sound waves longitudinally propagating in the gas passing through the at least one gas channel.

2. The sound absorber of claim 1, wherein, in the at least one longitudinal end region of the at least one helical fixture, an outer diameter of the helical fixture continuously decreases from an inner diameter of the tube to zero.

3. The sound absorber of claim 1, wherein the opposite impedance steps are provided by opposite changes of at least one of the pitch and of the diameter of the at least one helical fixture.

4. The sound absorber of claim 3, wherein the at least one helical fixture and an outer wall enclosing the at least one gas channel in the at least one longitudinal section comprise at least one local radial contraction.

5. The sound absorber of claim 3, wherein the at least one helical fixture and an outer wall enclosing the at least one gas channel in the at least one longitudinal section comprise at least one local radial expansion.

6. The sound absorber of claim 1, wherein the tube over the longitudinal cavity is essentially free of any helical fixture.

7. The sound absorber of claim 1, wherein the at least one gas channel has a circular cross-sectional area which is spanned by the at least one helical fixture by means of a double helix.

8. The sound absorber of claim 1, wherein the at least one gas channel comprises a ring-shaped cross-sectional area which is spanned by the at least one helical fixture by means of at least one helix.

9. The sound absorber of claim 1, wherein gas passing through the sound absorber is distributed over the at least one gas channel and at least one further gas channel which is connected in parallel to the at least one gas channel.

10. The sound absorber of claim 9, wherein at least one further longitudinal Helmholtz resonator is defined in the at least one further gas channel by at least one further helical fixture mounted in the at least one further gas channel.

11. The sound absorber of claim 10, wherein that the at least one longitudinal Helmholtz resonator and the at least one further longitudinal Helmholtz resonator are tuned to a same resonant frequency.

12. The sound absorber of claim 10, wherein that the at least one longitudinal Helmholtz resonator is constructed as an acoustic parallel circuit and the at least one further longitudinal Helmholtz resonator is constructed as an acoustic series circuit.

13. The sound absorber of claim 1, wherein the at least one longitudinal Helmholtz resonator at least one further longitudinal Helmholtz are longitudinally connected in series within the at least one gas channel.

14. The sound absorber of claim 13, wherein that the at least one longitudinal Helmholtz resonator and the at least one further longitudinal Helmholtz resonator are tuned to a same resonant frequency.

15. The sound absorber of claim 13, wherein that the at least one longitudinal Helmholtz resonator and the at least one further longitudinal Helmholtz resonator are tuned to different resonant frequencies which are equal to discrete sound frequencies of the sound waves propagating in the gas passing through the at least one gas channel.

16. The sound absorber of claim 1, wherein the at least one helical fixture is actively deformable.

17. The sound absorber of claim 16, wherein the at least one helical fixture comprises at least one functional material.

18. A sound absorber comprising:

at least one elongated gas channel, through which a flowing gas passes in operation of the sound absorber; and at least two helical fixture mounted at a longitudinal distance in at least one longitudinal section of the at least one gas channel, wherein each of the at least two helical fixture separate two helical gas passages through the at least one longitudinal section of the gas channel;

wherein the at least two helical fixture define between them at least one longitudinal Helmholtz resonator cavity within the gas channel which is excited by sound waves propagating in the gas passing through the at least one gas channel; and wherein the at least two helical fixtures comprise longitudinal end regions at their far ends in which outer diameters of the at least two helical fixture taper and get away from a wall of the tube circumferentially enclosing the at least one gas channel such that the outer diameters continuously decrease from an inner diameter of the tube to zero resulting in a low reflection soft impedance transition.

19. A system comprising:

at least one of an engine and of a pump; and a tube including a sound absorber, the sound absorber comprising:

at least one elongated gas channel, through which a gas passes in operation of the sound absorber; and at least one helical fixture mounted in at least one longitudinal section of the at least one gas channel, wherein the at least one helical fixture separates two helical gas passages through the at least one longitudinal section of the gas channel;

wherein the at least one helical fixture comprises at least one longitudinal end region in which an outer diameter of the at least one helical fixture tapers and gets away from a wall circumferentially enclosing the at least one gas channel resulting in a low reflection soft impedance transition;

wherein the at least one helical fixture defines at least one longitudinal Helmholtz resonator within the gas channel which is excited by sound waves propagating in the flowing gas passing through the at least one gas channel; and wherein the at least one longitudinal Helmholtz resonator comprises a longitudinal cavity within the at least one gas channel, which is delimited by opposite impedance steps for the sound waves longitudinally propagating in the gas passing through the at least one gas channel.

20. The sound absorber of claim 19, wherein, in the at least one longitudinal end region of the at least one helical fixture, an outer diameter of the helical fixture continuously decreases from an inner diameter of the tube to zero.

* * * * *